US008132583B2

(12) United States Patent
Mowatt, Sr.

(10) Patent No.: US 8,132,583 B2
(45) Date of Patent: Mar. 13, 2012

(54) METHOD OF FORMING A RAINTROUGH FOR A RECREATIONAL VEHICLE AWNING

(76) Inventor: James Stewart Mowatt, Sr., St. Albert (CA)

( * ) Notice: Subject to any disclaimer, the term of this patent is extended or adjusted under 35 U.S.C. 154(b) by 94 days.

(21) Appl. No.: 12/763,382

(22) Filed: Apr. 20, 2010

(65) Prior Publication Data

US 2011/0253183 A1 Oct. 20, 2011

(51) Int. Cl.
*E04H 15/08* (2006.01)
*E04F 10/00* (2006.01)

(52) U.S. Cl. ..... 135/88.12; 135/88.07; 135/117; 135/905; 160/47; 52/74; 52/13; 248/48.2

(58) Field of Classification Search ..... 135/88.1, 135/88.05, 88.07, 88.09, 115, 117, 119, 905; 160/44, 47; 52/11, 13–14, 74–76; 248/48.1, 248/48.2

See application file for complete search history.

(56) References Cited

U.S. PATENT DOCUMENTS

| | | | | | |
|---|---|---|---|---|---|
| 435,173 | A | * | 8/1890 | Forbes | 211/69.4 |
| 2,568,048 | A | | 9/1951 | Arnold | |
| 2,573,060 | A | | 10/1951 | Rauglas | |
| 3,138,832 | A | * | 6/1964 | Gonnello | 52/11 |
| 3,334,454 | A | * | 8/1967 | Abrams | 52/11 |
| 3,698,409 | A | * | 10/1972 | Koontz et al. | 114/361 |
| 3,805,816 | A | * | 4/1974 | Nolte | 135/115 |
| 3,923,074 | A | * | 12/1975 | McKee | 160/22 |
| 4,077,419 | A | | 3/1978 | Lux | |
| 4,658,877 | A | * | 4/1987 | Quinn | 160/46 |
| 5,148,849 | A | * | 9/1992 | Faludy | 160/67 |
| 5,203,055 | A | * | 4/1993 | Broadwater, Sr. | 24/462 |
| 5,246,052 | A | * | 9/1993 | Homan | 160/65 |
| 5,706,608 | A | * | 1/1998 | Sweet | 52/11 |
| 5,718,253 | A | | 2/1998 | McNamee | |
| 6,488,069 | B1 | | 12/2002 | Mashaw et al. | |
| 7,100,625 | B2 | * | 9/2006 | Valles | 135/88.13 |
| 2009/0293927 | A1 | * | 12/2009 | Goldwitz | 135/121 |

FOREIGN PATENT DOCUMENTS

JP 2006112120 A * 4/2006

OTHER PUBLICATIONS

Dippy Gutter, Website information, www.dippygutter.com (6 pages), Jan. 7, 2010.

* cited by examiner

*Primary Examiner* — Winnie Yip
(74) *Attorney, Agent, or Firm* — Donald V. Tomkins

(57) ABSTRACT

A raintrough support clip includes a generally cylindrical main body made from an elastically resilient material, and having a circumferential gap to facilitate mounting of the main body around the awning reel of a recreation vehicle awning assembly of the type having a flexible valance sheet extending downward from the outer edge of the awning reel. The raintrough support clip also has an outrigger member extending outwardly from a lower region of the main body, with an upturned portion forming a generally U-shaped space between the outrigger and the main body. When a suitable number of the raintrough support clips are mounted along the length of the awning reel, the valance sheet may be readily deformed to form a rainwater drainage trough for receiving runoff from the awning. The drainage trough thus formed will carry runoff to one or both ends of the awning reel, thereby preventing the runoff from falling over the awning reel and forming a runoff curtain therebelow.

7 Claims, 5 Drawing Sheets

METHOD OF FORMING A RAINTROUGH FOR A RECREATIONAL VEHICLE AWNING

FIELD OF THE INVENTION

The present invention relates in general to methods and apparatus for controlling rainwater runoff from roll-up awnings for trailers and other recreational vehicles.

BACKGROUND OF THE INVENTION

It is common for a recreational vehicle (RV) such as a trailer, camper, or motor home to be fitted with an awning assembly that can be deployed when the RV is parked to provide shade and rain protection for an area adjacent to the parked RV. The awning assembly can be retracted and stowed against the side of the RV when not in use, such as when the RV is in transit. U.S. Pat. No. 4,077,419 (Lux) illustrates one example of a prior art RV awning assembly.

A typical RV awning assembly includes an elongate awning reel, each end of which is rotatably connected to the upper end of a telescoping strut, the lower end of which is rotatably connected to a lower region of a sidewall of the RV. A rectangular awning sheet, typically made from a waterproof or water-resistant fabric, has an upper edge that is attached to an upper region of the RV sidewall, and a parallel lower edge attached to the awning reel. The assembly is provided with springs or other biasing means effective to cause the awning sheet to roll up around the awning reel when the struts and awning reel are rotated toward the RV sidewall.

Such RV awning assemblies commonly incorporate a fabric-type valance sheet which is typically integral or contiguous with the awning sheet and hangs down over the awning reel. The valance provides a partial sunshade, and may also add aesthetic appeal. The assembly is configured such that the deployed awning always slopes toward the reel, such that rain falling on the awning will naturally flow toward the reel and then over the valance.

Awning assemblies as described above enhance RV owners' enjoyment of their RVs by allowing them to sit outside in dry comfort during rain showers. In such conditions, however, a rainwater runoff curtain forms directly below and along the full length of the awning reel and valance. Persons sitting under the awning during a rain shower may often wish to step out of the awning-protected area for one reason or another in spite of the rain, but if they exit this area under the awning reel they typically have to pass through the runoff curtain (because exiting under the sloping side edges of the awning is typically inconvenient or impossible due to the awning reel support struts). Accordingly, they will be susceptible to a soaking from the runoff curtain that will be considerably more concentrated than the rainfall itself, due to the fact that the runoff curtain concentrates all of the rain falling over the entire surface area of the awning.

In addition, the runoff curtain creates a wet and often muddy zone on the ground surface below and along the length of the awning reel. For persons entering or exiting the awning-protected area during or after a rain shower, this wet/muddy zone presents an inconvenience at best and a slipping hazard at worst.

A further inconvenience caused by a runoff curtain below an awning reel is that it impairs the view of persons sitting under the awning, and this impairment of course increases with rainfall intensity.

U.S. Pat. No. 6,488,069 (Mashaw et al.) and corresponding Canadian Patent No. 2,353,299 represent one example of a prior art attempt to control rainwater runoff from an RV awning assembly. Mashaw teaches an awning assembly with a mechanism adapted to automatically lower one sloping side edge of the awning when a predetermined weight of water has collected on the awning, such that the awning is temporarily deformed to create a channel to divert and drain the accumulated water toward the lowered side edge of the awning, whereupon springs return the awning to its original position. However, this apparatus is mechanically complex, with various moving parts that are prone to wear and possible malfunction. Moreover, it does not address the aforementioned problems of a concentrated runoff curtain under the lower edge of the awning, except on a brief and intermittent basis, and it produces a concentrated runoff stream that is simply dumped onto the ground in an adjacent area.

Another prior art approach to controlling RV awning runoff is the "Dippy Gutter" system sold by Dippy Gutter, LLC of Riverside, Ala. In accordance with this system, a gutter formed of fabric is attached along the lower edge of an existing RV awning (i.e., adjacent the awning reel), with the gutter draining into a flexible downspout at one end of the gutter. This system will effectively prevent the formation of a runoff curtain below the awning reel, but it has certain practical drawbacks. Each "Dippy Gutter" must be custom-fit to the length of the RV awning in question, and the existing awning assembly needs to be modified to receive the fasteners that are required for attaching the gutter. When not in use, the "Dippy Gutter" can be rolled up for storage, but first it has to be dried out, and when in storage it takes up a significant amount of space that might otherwise be used for other purposes.

For the foregoing reasons, there is a need for improved apparatus and methods for controlling rainwater runoff from RV awnings, and in particular for preventing the formation of a runoff curtain under the lower edge of an RV awning, preferably with apparatus having no moving parts. There is a further and related need for such apparatus and methods that also facilitate removal and diversion of awning runoff to a disposal area a reasonable distance away from the awning assembly. The present invention is directed to these needs.

BRIEF SUMMARY OF THE INVENTION

In one aspect, the present invention provides a raintrough support bracket or "clip" that is removably mountable to the cylindrical awning reel of an RV awning assembly of the type incorporating an awning sheet connected or fastened to the awning reel along a longitudinal awning connection line, plus a valance sheet extending downward from the awning reel. The raintrough support clip (or simply, "raintrough clip") is configured to facilitate deformation of the valance to form a rainwater drainage trough (or "raintrough") when a number of raintrough clips are mounted or "clipped" onto the awning reel as explained and illustrated herein. Rainwater flowing downward over the awning will therefore flow into the raintrough thus formed, rather than flowing over the awning reel.

In one embodiment, the present invention provides a raintrough support clip, for mounting around the awning reel of a recreation vehicle awning assembly of the type having:

(a) an awning sheet anchored to an elongate awning reel along a longitudinal awning connection line; and (b) a flexible valance sheet extending downward from the outer edge of the awning reel;

said raintrough support clip comprising:

(c) a generally cylindrical main body having a circumferential gap extending between an upper longitudinal edge and a lower longitudinal edge; and (d) an outrigger member cantilevering outward from a lower region of the main body, said outrigger member having an upturned portion and forming a generally U-shaped space between the outrigger member and the main body;

such that the main body is elastically deformable for mounting around the awning reel with the upper longitudinal edge of the main body disposed under the awning sheet of the awning assembly, adjacent to the awning connection line.

After a suitable number of raintrough support clips have been mounted along the length to the awning reel, the valance sheet may be readily deformed to form a generally U-shaped raintrough along the outer edge of the awning reel and supported by the outrigger members. The weight of the awning and the raintrough support clips will induce rotational forces urging the upper longitudinal edge of the main body against the awning connection line, thus stabilizing the raintrough support clips and the raintrough formed by the valance sheet.

In a second aspect, the present invention provides a method of controlling rainwater runoff from an RV awning/valance assembly by deforming the valance to form a raintrough using raintrough support clips in accordance with the aforesaid first aspect of the invention. In accordance with one embodiment, the invention provides a method of forming a raintrough from the valance sheet of a recreation vehicle awning assembly of the type having: an awning sheet anchored to an elongate awning reel along a longitudinal awning connection line; and a flexible valance sheet extending downward from the outer edge of the awning reel; wherein the method comprises the steps of:

(a) providing a plurality of raintrough support clips, each said raintrough support clip comprising:
  - a.1 a generally cylindrical main body having a circumferential gap extending between an upper longitudinal edge and a lower longitudinal edge, said main body being made from an elastically-resilient material; and
  - a.2 an outrigger member cantilevering outward from a lower region of the main body, said outrigger member having an upturned portion and forming a generally U-shaped space between the outrigger member and the main body; and (b) mounting each raintrough support clip to the awning reel in a selected location along the length thereof, by:
  - b.1 elastically spreading the upper and lower longitudinal edges of the raintrough support clip's main body sufficiently to allow the main body to be disposed around the awning reel; and
  - b.2 disposing the raintrough support clip's main body around the awning reel in a selected location along the length thereof, such that the upper longitudinal edge of the main body is disposed under the awning sheet adjacent to the awning connection line; and (c) deforming the valance sheet into the U-shaped spaces of the outrigger members of the raintrough support clips, to form a raintrough adjacent to the awning reel such that rainwater falling upon the awning sheet will flow into said raintrough.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
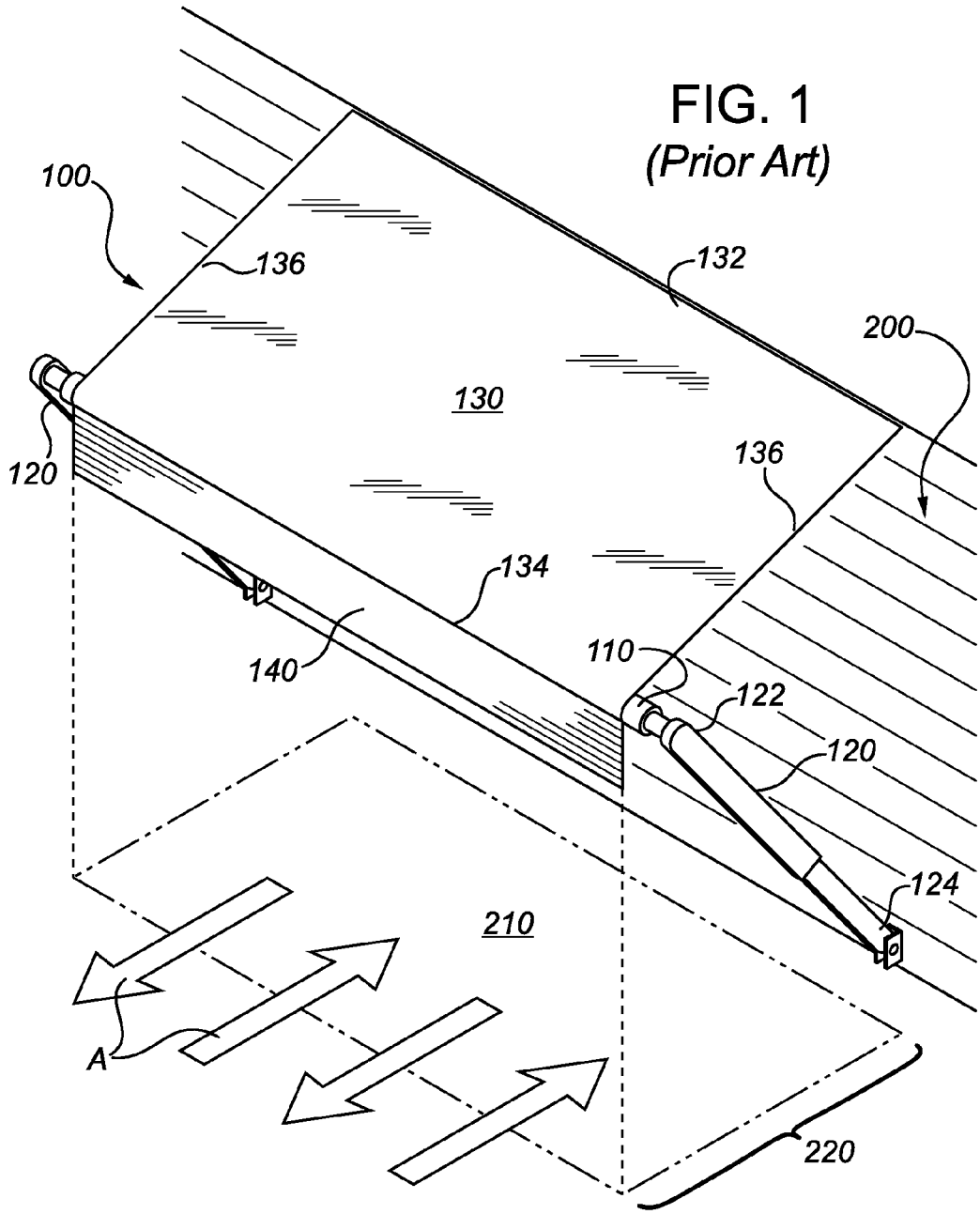
FIG. 1 (Prior Art)
FIG. 1 is an isometric view of a prior art RV awning/valance assembly.

FIG. 1 illustrates a common type of prior-art awning assembly 100 for a recreational vehicle (RV) 200. Awning assembly 100 comprises an elongate awning reel 110, each end of which is rotatably connected to the upper end 122 of a telescoping strut 120, the lower end 124 of which is rotatably connected to a lower region of a sidewall of RV 200. Awning assembly 100 also includes: a pliable and typically rectangular awning sheet 130 having an upper edge 132 that is fastened to an upper sidewall region of RV 200; a parallel lower edge 134 fastened or otherwise anchored to awning reel 110; and sloping side edges 136. A pliable valance sheet 140, typically contiguous or integral with awning sheet 130, extends downward alongside the outer side of awning reel 110, such that rainwater flowing over awning sheet 130 toward lower edge 134 thereof will thence flow down the face of valance sheet 140.

When deployed as illustrated in FIG. 1, awning assembly 100 acts as a sun and rain shield for a protected area 210 adjacent to RV 200. Persons wanting to use protected area 210 will usually prefer to enter and exit protected area 210 by passing under awning reel 110, as schematically illustrated by traffic flow arrows A in FIG. 1. Access into and out of protected area 210 in side regions 220 beneath sloping side edges 136 of awning sheet 130 will typically be difficult and even potentially hazardous due to the obstacles represented by the telescoping struts 120, which extend diagonally across the area below side edges 136.

Figure 2:
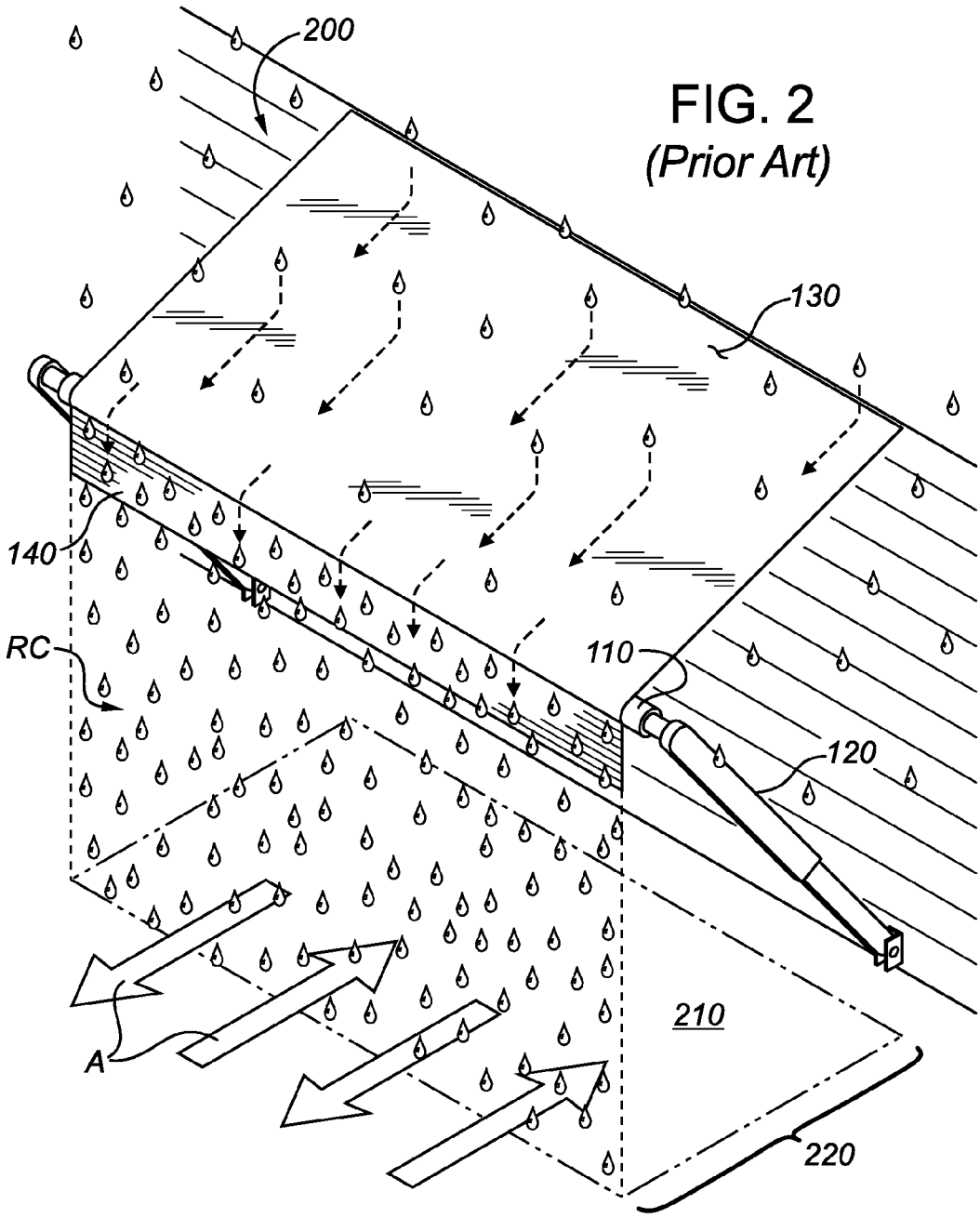
FIG. 2 (Prior Art)
FIG. 2 is an isometric view of a prior art RV awning/valance assembly as in FIG. 1, illustrating the runoff curtain that develops when rain falls on the awning.

FIG. 2 graphically illustrates the formation of a rainwater runoff curtain RC below valance 140 due to rainfall upon awning sheet 130. Persons walking under valance 140 (as indicated by traffic flow arrows A) during a rain shower must pass through runoff curtain RC, which constitutes a flow of water having a concentration or intensity greater than that of the rain shower, and which therefore causes correspondingly greater discomfort.

Figure 3:
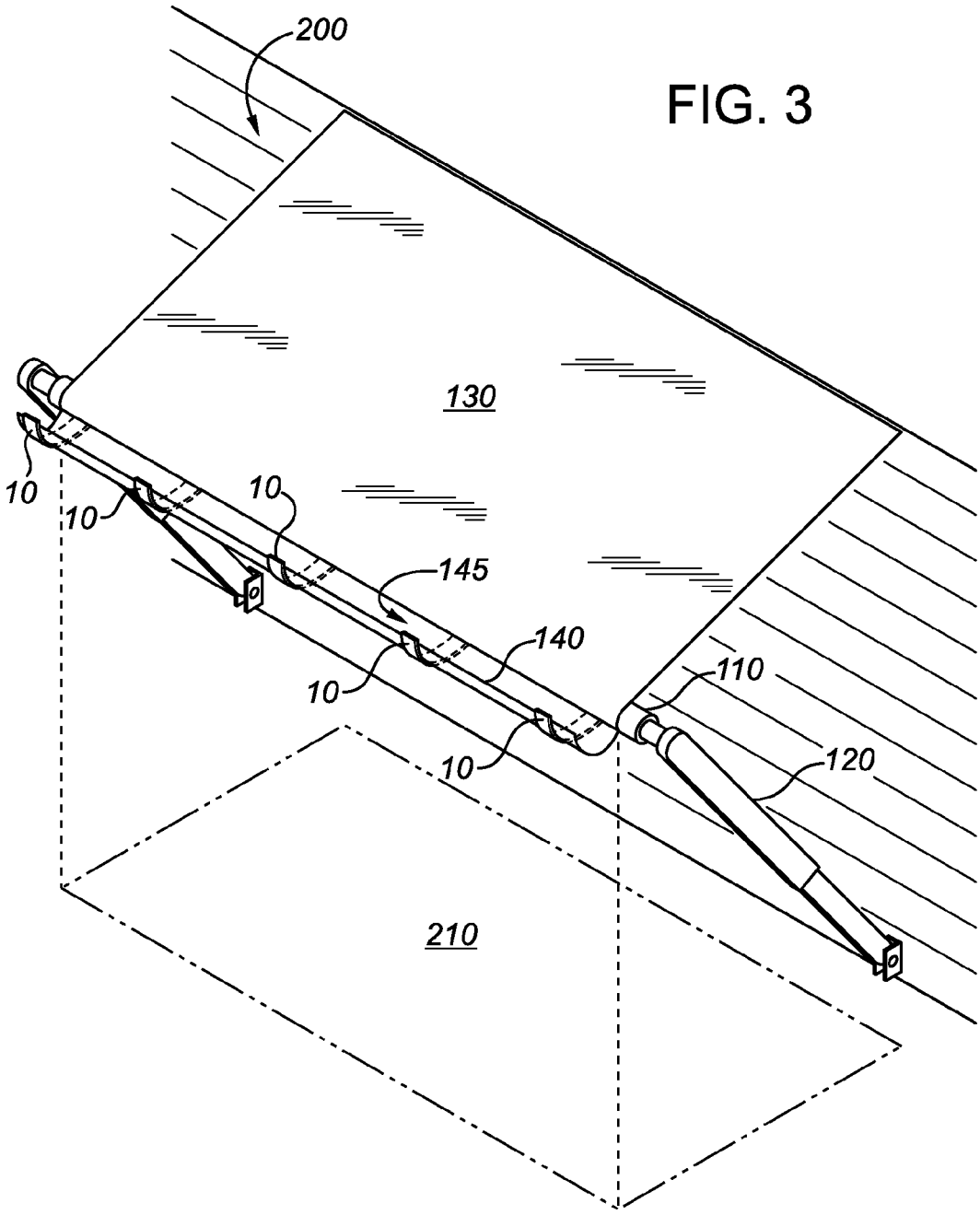
FIG. 3 is an isometric view of a prior art RV awning/valance assembly as in FIG. 1, fitted with raintrough clips in accordance with a first embodiment of the present invention.
Figure 4:
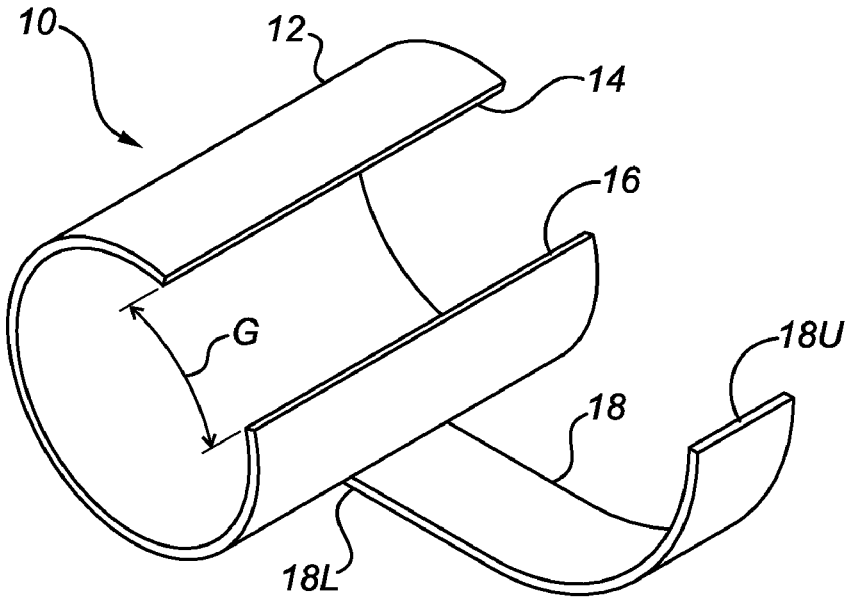
FIG. 4 is an isometric view of the assembly of FIG. 3, further fitted with a raintrough extension in accordance with a second embodiment of the invention.
Figure 5:
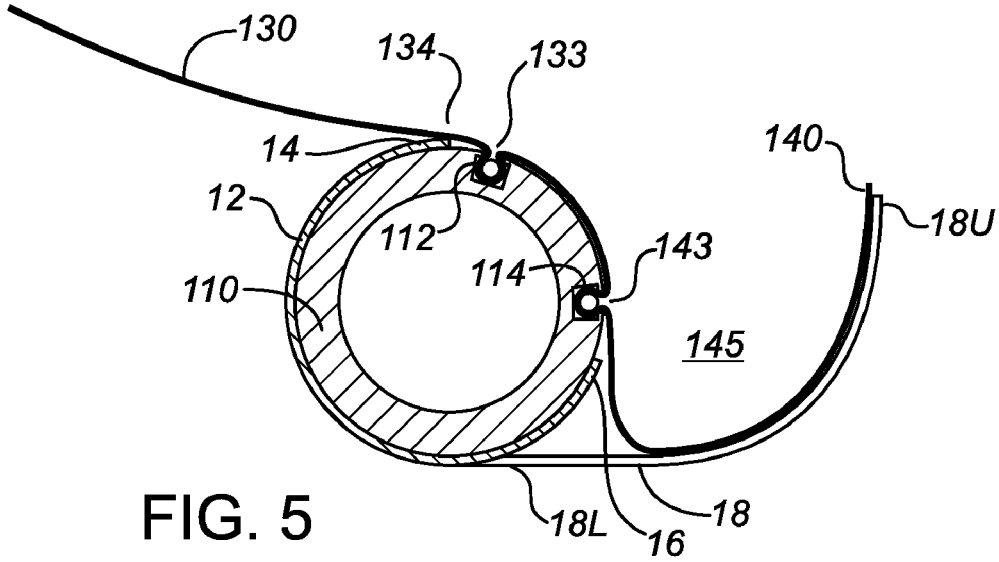
FIG. 5 is an isometric view of a raintrough clip in accordance with a first embodiment of the present invention.

FIGS. 3, 4, and 5 illustrate how the formation of a runoff curtain below an RV awning reel can be prevented using raintrough clips 10 in accordance with the present invention. As shown in FIG. 4, raintrough clip 10 comprises a main body 12 in the form of an open-ended cylindrical tube having a discontinuous circumference such that main body 12 is generally "C-shaped" in cross section, with an upper longitudinal edge 14 and a lower longitudinal edge 16. The arcuate or angular length of the discontinuity or gap G between upper and lower edges 14 and 16 will depend on the configuration and construction details of the particular awning/valance assembly that the raintrough clips 10 are to be mounted on. Main body 12 of raintrough clip 10 is made from a reasonably stiff but elastically-deformable material (such as but not limited to polyvinylchloride (PVC) or other suitable plastic material), and has an inside diameter corresponding (more or less) to the outer diameter of the awning reel 110 in question, such that main body 12 can be elastically deformed to fit around a lower region of awning reel 110 below awning sheet 130, generally as shown in FIG. 5.

Raintrough clip 10 also incorporates an outrigger member 18 having an upper end 18U and a lower end 18L, with lower end 18L being rigidly connected to and cantilevering from a selected point in a lower region of main body 12. In preferred embodiments, outrigger 18 will be formed integrally with main body 12 (for example, as a unitary plastic molding). However, other known means and methods (for example: welding, adhesives, chemical bonding) may alternatively be used to provide sufficient connective rigidity between lower end 18L of outrigger 18 and main body 12.

As shown in FIG. 4, outrigger 18 is configured so as to extend outward and away from main body 12, such that upper end 18U of outrigger 18 is at a higher elevation than lower end 18L when raintrough clip 10 is mounted to awning reel 110, thus forming a generally U-shaped space between outrigger 18 and main body 12. In the embodiment shown in FIG. 4, outrigger 18 is formed with a smooth curvature to achieve this generally U-shaped configuration. However, such curvature is not essential, and in alternative embodiments outrigger 18 may incorporate straight or rectilinear segments, with or without curved segments. In FIGS. 4 and 5, lower end 18L of outrigger 18 is shown as being substantially tangential to the outer diameter of awning reel 110, but this is a matter of preference rather than necessity. In alternative embodiments, the angular orientation of lower end 18L of outrigger 18 relative to awning reel 110 may be other than tangential, and all such alternative embodiments are intended to be within the scope of the present invention.

FIG. 5 shows a raintrough clip 10 mounted to an awning reel 110 in accordance with the present teachings. For illustration purposes, awning reel 110 is shown as having a first longitudinal channel 112 for retainingly receiving a welt or seam 133 formed into lower edge 134 of awning sheet 130, thus providing the awning-to-reel connection required in order for awning 130 to roll up around reel 110 during retraction of awning assembly 100. As well, awning reel 110 is shown with a second longitudinal channel 114 for retainingly receiving a welt or seam 143 formed into valance sheet 140. Raintrough clip 10 mountable to awning reel 110 by elastically spreading upper and lower longitudinal edges 14 and 16 of main body 12 to widen gap G between upper and lower edges 14 and 16 of main body 12 enough to allow main body 12 to be slipped over awning reel 110. The spreading force on edges 14 and 16 of main body 12 may then be released, whereupon main body 12 will elastically rebound into position around a portion of awning reel 110 as shown in FIG. 5. Raintrough clip 10 may then be rotated such that upper longitudinal edge 14 of main body 12 is disposed under awning sheet 130 adjacent to first longitudinal channel 112 and awning seam 133 as shown in FIG. 5 (although gravity will tend to urge main body 12 into this position in any event, as discussed later herein).

When a suitable number of raintrough clips 10 have been installed along the length of awning reel 110, as shown by way of example in FIG. 3, valance sheet 140 may be readily deformed as shown in FIG. 5 to form a rainwater drainage trough (or "raintrough") 145 lying in the generally U-shaped space between outriggers 18 and main bodies 12 of raintrough clips 10. Therefore, rainwater flowing downward over awning sheet 130 will be directed into raintrough 145, which will carry the rainwater to a disposal point at either end of awning reel 110. Drainage toward a preferred end of awning reel 110 may be achieved by differential adjustment of telescoping arms 120 such that one end of awning reel 110 will be lower than the other end. Alternatively, raintrough clips 10 may be provided in different sizes, with slight variations in the configuration of outrigger 18, such that raintrough 145 will be formed with a slope or "fall" tending to direct run-off toward a selected end of raintrough 145.

The weight of the valance material resting on outriggers 18, not to mention the weight of any rainwater flowing into raintrough 145, will induce rotational forces tending to keep upper longitudinal edges 14 of main bodies 12 securely disposed in the crevice-like space between awning reel 110 and awning sheet 130, thereby stabilizing the position of raintrough 145 relative to awning assembly 100. The installed position of lower longitudinal edges 16 of main bodies 12 relative to awning reel 110 is therefore not critical.

Persons skilled in the art will readily appreciate that the raintrough clip of the present invention can be readily adapted for mounting to awning reels having a construction different from that of awning reel 110 in FIG. 5. For example, in other types of awning reels there may be only a single point or longitudinal connection or anchorage line between the awning/valance and the reel (rather than two connection/anchorage lines as in FIG. 5), and other types of awning reels may use different means of connecting the awning/valance to the reel (rather than the seam-in-channel means illustrated in FIG. 5). Of necessity, however, there will always be some point or line of connection between the awning/valance and the reel, thereby providing a reaction point for upper longitudinal edges 14 of outriggers 18 to bear against and thus stabilize the position of raintrough 145 relative to awning reel 110.

When it is desired to retract awning assembly 100, it is a simple matter to remove raintrough clips 10 by pulling them off of and away from awning reel 110.

Figure 6:
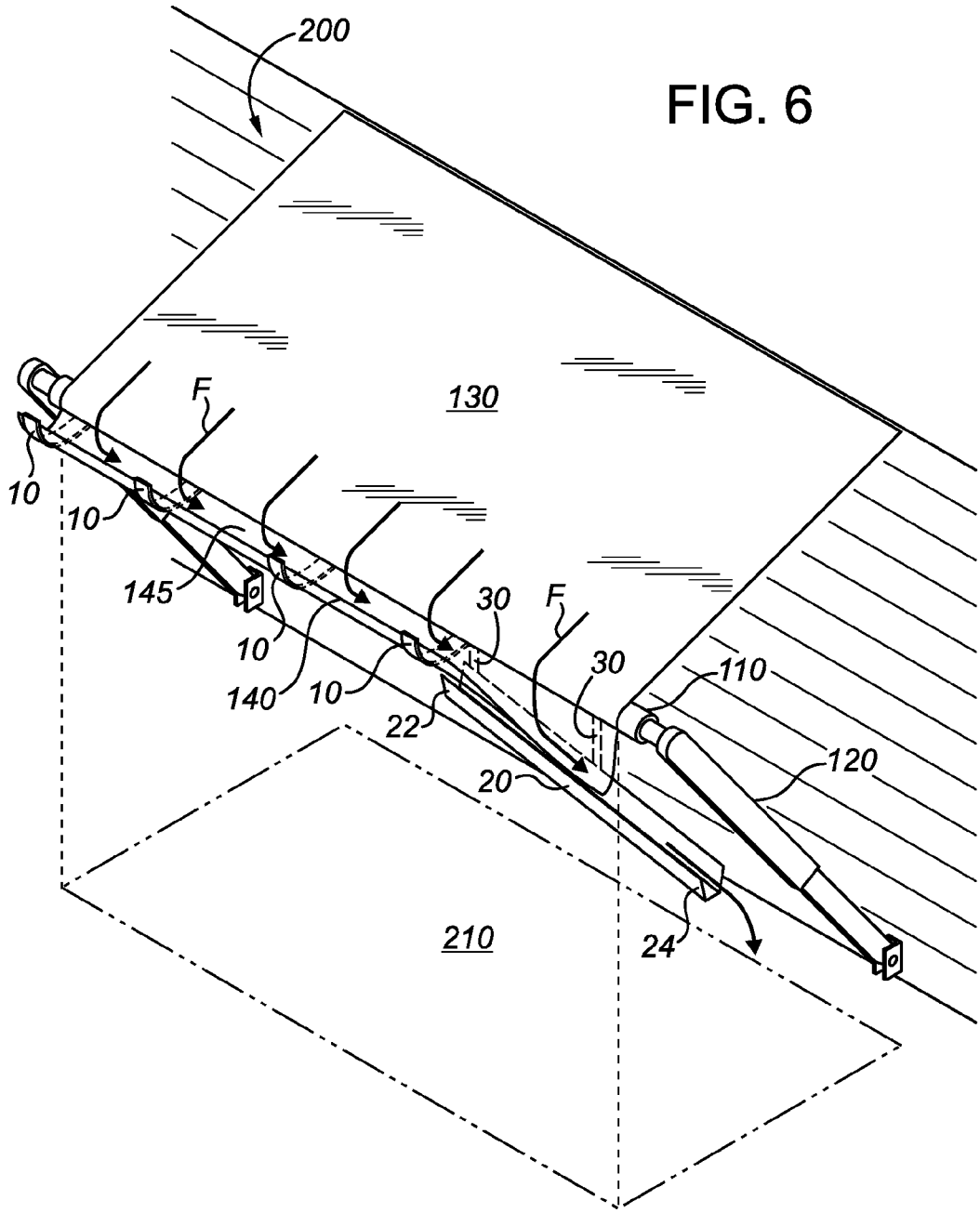
FIG. 6 is a cross-sectional view through an RV awning reel, awning, and valance, with a raintrough clip in accordance with FIG. 5 fitted to the awning reel.

FIG. 6 illustrates how rainwater runoff will flow by gravity from awning sheet 130 into raintrough 145, as conceptually indicated by flow arrows F. In the exemplary arrangement shown in FIG. 6, raintrough 145 slopes toward one end of awning reel 110, with an optional raintrough extension 20 being provided to direct the runoff to a disposal or collection point beyond the end of awning reel 110. Raintrough extension 20 has an inner end 22 which will be disposed underneath raintrough 145, and an outflow end 24. As shown in FIG. 6, one end of raintrough 145 may optionally be downwardly deflected to optimize runoff flow from raintrough 145 into raintrough extension 20. However, persons skilled in the art will appreciate that raintrough extension 20 can also be readily mounted to a raintrough 145 not having a downward deflection at one end, without detracting from its effectiveness in carrying runoff away from raintrough 145.

By way of non-limiting example, raintrough extension 20 may be provided in the form of a length of conventional metal or PVC eavestroughing. Raintrough extension 20 may be suspended from awning reel 110 (and/or from one or more raintrough clips 10) by means of suitable hanger straps 30 and fastening means (sheet metal screws, for example).

It will be readily appreciated by those skilled in the art that various modifications of the present invention may be devised without departing from the scope and teaching of the present invention, including modifications which may use equivalent structures or materials hereafter conceived or developed. It is to be especially understood that the invention is not intended to be limited to any described or illustrated embodiment, and that the substitution of a variant of a claimed element or feature, without any substantial resultant change in the working of the invention, will not constitute a departure from the scope of the invention. It is also to be appreciated that the different teachings of the embodiments described and discussed herein may be employed separately or in any suitable combination to produce desired results.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element. Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure. Relational terms such as "parallel", "perpendicular", "coincident", "intersecting", and "equidistant" are not intended to denote or require absolute mathematical or geometrical precision. Accordingly, such terms are to be understood as denoting or requiring substantial precision only (e.g., "substantially parallel") unless the context clearly requires otherwise.

What is claimed is:

1. A method of forming a raintrough from the valance sheet of a recreation vehicle awning assembly of the type having: an awning sheet anchored to an elongate awning reel along a longitudinal awning connection line; and a flexible valance sheet extending downward from the outer edge of the awning reel; said method comprising the steps of:

(a) providing a plurality of raintrough support clips, each said raintrough support clip comprising:

a.1 a generally cylindrical main body having a circumferential gap extending between an upper longitudinal edge and a lower longitudinal edge, said main body being made from an elastically-resilient material; and a.2 an outrigger member cantilevering outward from a lower region of the main body, said outrigger member having an upturned portion and forming a generally U-shaped space between the outrigger member and the main body; and (b) mounting each raintrough support clip to the awning reel in a selected location along the length thereof, by:

b.1 elastically spreading the upper and lower longitudinal edges of the raintrough support clip's main body sufficiently to allow the main body to be disposed around the awning reel; and b.2 disposing the raintrough support clip's main body around the awning reel in a selected location along the length thereof, such that the upper longitudinal edge of the main body is disposed under the awning sheet adjacent to the awning connection line; and (c) deforming the valance sheet into the U-shaped spaces of the outrigger members of the raintrough support clips, to form a raintrough adjacent to the awning reel such that rainwater falling upon the awning sheet will flow into said raintrough.

2. The method of claim 1 wherein the outrigger member of at least one of the raintrough support clips incorporates a curvilinear portion.

3. The method of claim 1 wherein the outrigger member of at least one of the raintrough support clips is of rectilinear configuration.

4. The method of claim 1 wherein at least one of the raintrough support clips is made from an elastically-resilient plastic material.

5. The method of claim 1 comprising the further step of forming the raintrough to have a slope toward a selected end of the awning reel.

6. The method of claim 1 comprising the further step of providing a raintrough extension having an inner portion disposed underneath an end portion of the raintrough formed from the valance sheet, and an outer portion extending beyond said end portion of the raintrough.

7. The method of claim 6 wherein the inner portion of the raintrough extension is suspended from the awning reel by a plurality of hanger straps.

* * * * *